United States Patent [19]

Yamamoto

[11] 4,118,827

[45] Oct. 10, 1978

[54] DOOR HINGE ATTACHMENT DEVICE

[75] Inventor: Yukio Yamamoto, Uozu, Japan

[73] Assignee: Yoshida Kogyo K.K., Tokyo, Japan

[21] Appl. No.: 790,083

[22] Filed: Apr. 22, 1977

[30] Foreign Application Priority Data

Apr. 30, 1976 [JP] Japan ..... 51-55394[U]

[51] Int. Cl.[2] ..... E05D 11/00; E06B 3/00

[52] U.S. Cl. ..... 16/137; 16/129; 49/501; 49/381

[58] Field of Search ..... 16/137, 128 R, 129; 49/501, 381, 398

[56] References Cited

U.S. PATENT DOCUMENTS

| | | | |
|---|---|---|---|
| 2,925,894 | 2/1960 | Lee, Jr. et al. | 16/137 X |
| 3,287,856 | 11/1966 | Passovoy | 49/381 X |
| 3,423,878 | 1/1969 | Kimmel | 49/501 |
| 3,828,394 | 8/1974 | Horgan, Jr. | 49/501 X |

FOREIGN PATENT DOCUMENTS

| | | | |
|---|---|---|---|
| 708,799 | 5/1931 | France | 49/501 |
| A81,319 | 1/1962 | France | 49/501 |
| 2,226,861 | 11/1974 | France | 16/129 |

*Primary Examiner*—James Kee Chi

*Attorney, Agent, or Firm*—Hill, Gross, Simpson, Van Santen, Steadman, Chiara & Simpson

[57] ABSTRACT

A door hinge attachment device for a door having a core of hardboard or like relatively soft material sandwiched between and adhered to a pair of face panels and the resulting assembly. The attachment device includes a pair of gripping jaws embracing the hinged edge of the door and bolted thereto, and a mounting plate integral with one of the gripping jaws and tongue-and-groove jointed to or integral with the other. Fitted flush in a recess in the door edge, the mounting plate has a set of tapped holes to permit one of the leaves of a butt hinge to be screwed thereto through a frame member extending along and embracing the peripheral edges of the door.

9 Claims, 3 Drawing Figures

DOOR HINGE ATTACHMENT DEVICE

BACKGROUND OF THE INVENTION

1. Field of the Invention

The present invention relates to an attachment device for fastening one of the leaves of a butt hinge to an edge of a door and the resulting assembly.

2. Description of the Prior Art

With the advent of doors having a core of particle board, hardboard, or like comparatively soft material sandwiched between and secured to a pair of face panels as by an adhesive, a problem has arisen in connection with the fastening of hinge leaves to their edges. The particle board, hardboard, or similar material constituting the cores of such doors is not sufficiently rigid to enable the hinge leaves to be screwed directly thereto with a required degree of firmness or rigidity. Heretofore, this problem has been circumvented by screwing the hinge leaves to a metal frame or other attachment screwed or otherwise fastened to the edge of the door. Such conventional measures are unsatisfactory because the frame or other attachment is itself insecurely connected to the door.

SUMMARY OF THE INVENTION

It is an object of the present invention to provide an efficient and durable attachment device for enabling a hinge to be firmly fastened to an edge of a door of the aforementioned type.

Another object of the present invention is to provide a door hinge attachment device which is simple and inexpensive to manufacture and which can be readily mounted to a door.

A further object of the present invention is to provide a door hinge attachment device which is equally applicable to either left- or right-swinging doors.

These and other objects are met in accordance with the invention by a door hinge attachment device comprising a pair of gripping jaws disposed on the opposite sides of a door adjacent to an edge thereof and rigidly connected to the door by fastener means extending transversely therethrough. Integral with at least one of the paired gripping jaws, a mounting plate is held against the door edge and has a set of holes therein. One of the leaves of a door hinge is fastened to the mounting plate by means of threaded fasteners such as screws passing through holes in the hinge leaf and threadedly into the holes in the mounting plate.

In order to make the attachment device adaptable for doors of various thickness, the mounting plate may be integral with only one of the gripping jaws and jointed to the other through, for example, a tongue and groove. If desired, the mounting plate may be integral with both gripping jaws, in order that the device may be readily mounted to a door of predetermined thickness. In both cases, the mounting plate together with the pair of gripping jaws can be readily mounted to either left- or right-swinging doors.

Preferably, the mounting plate should be fitted in a recess in the door edge, and the pair of gripping jaws should be fastened to the door by means of bolts and nuts received in, and mated together within, holes formed transversely through the door. Thus, since the mounting plate is held in place in the door edge and is integral with one or both of the paired gripping jaws firmly bolted together so as to embrace the door, the hinge can be securely screwed to the door through the mounting plate, practically without any possibility of loosening during its useful life. The attachment device in accordance with this invention is ready for mounting on the door merely by providing a recess or mortise in its edge and a set of transverse holes therethrough.

Many other advantages, features and additional objects of the present invention will become manifest to those versed in the art upon making reference to the detailed description and the accompanying drawings in which preferred structural embodiments incorporating the principles of the present invention are shown by way of illustrative example.

DESCRIPTION OF THE PREFERRED EMBODIMENTS

Figure 1:
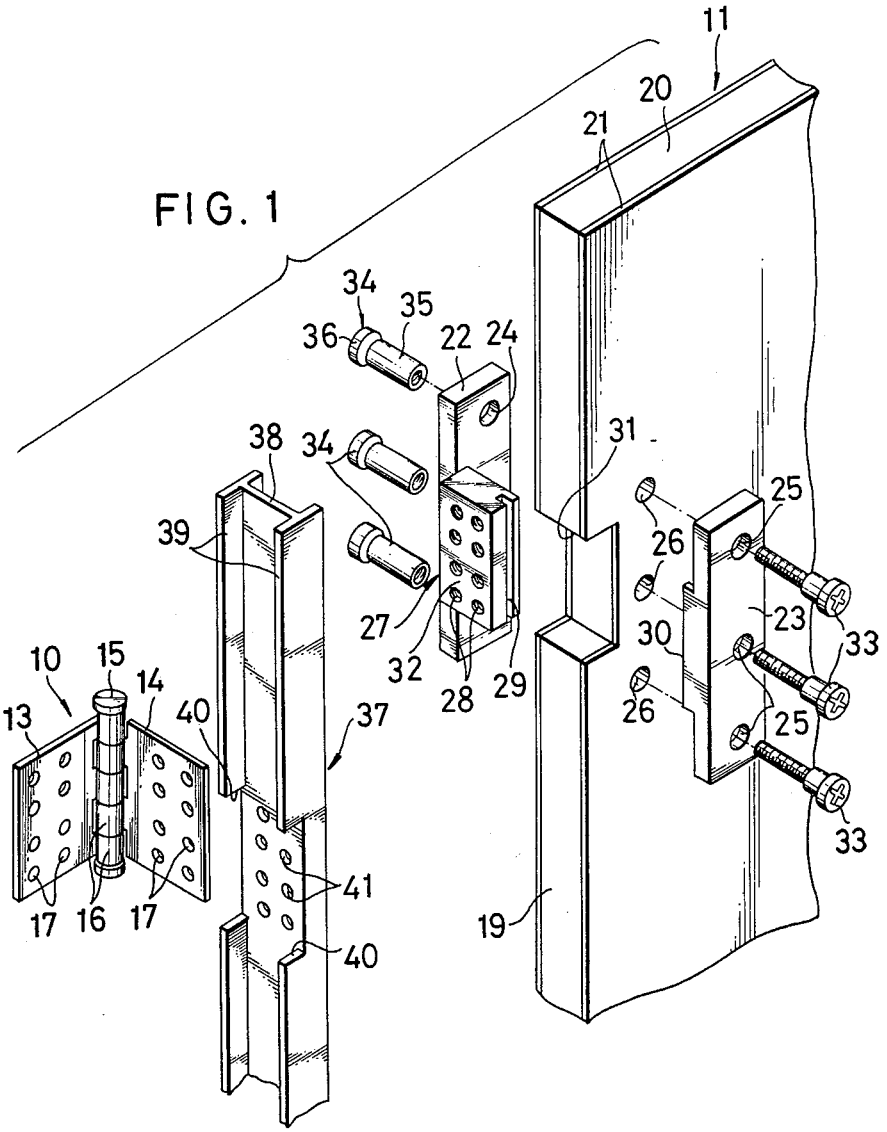
FIG. 1 is an exploded perspective view showing a door hinge attachment device in accordance with this invention, together with a door, a butt hinge, and a frame member, the door and the frame member being shown fragmentarily.
Figure 2:
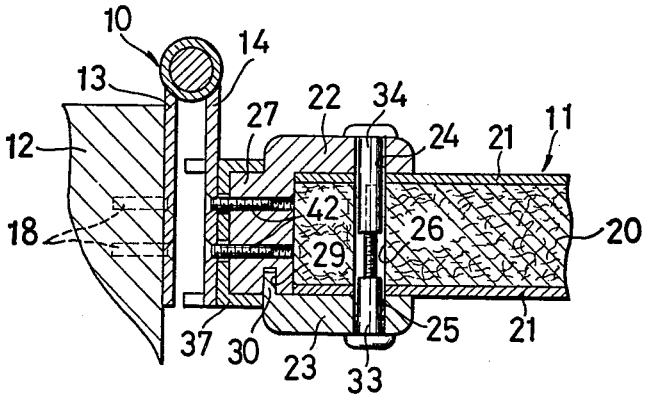
FIG. 2 is a horizontal cross-sectional view showing the parts of FIG. 1 assembled together and the door swingably connected to a complemental doorframe.

In FIGS. 1 and 2, a butt hinge 10 connects a door 11 pivotably to a complemental doorframe 12. The butt hinge 10 is of a conventional type comprising a pair of leaves 13, 14 pivotally joined together by a pintle having a headed top end 15 and accommodated in interfitting aligned knuckles 16 on and along the opposed hinging edges of the leaves.

Each of the paired hinge leaves 13, 14 has a set of countersunk holes 17 for the passage therethrough of threaded fasteners such as screws. The left hand hinge leaf 13 is fastened directly to the doorframe 12 by means of cap screws 18 passing through its countersunk holes 17.

This invention is includes an attachment device for fastening the right leaf 14 of the butt hinge 10 to an edge 19 of the door 11. The door 10 is of a known construction including a core 20 of particle board, hardboard, or similar relatively soft material that is sandwiched between and adhered to a pair of face panels 21, 21.

The door hinge attachment device includes a pair of first and second gripping jaws 22, 23 disposed on the opposite sides of the door 11 adjacent to its edge 19. The first gripping jaw 22 has a set of holes 24 (one seen in FIG. 1) arranged in a vertical row in axial registry with a similar set of holes 25 in the second gripping jaw 23 and further with the another similar set of holes 26 provided transversely and horizontally through the door 11.

Integral with the first gripping jaw 22 is a mounting plate 27 which is disposed in right angular relationship thereto and which has a set of tapped holes 28 disposed in two vertical rows in registry with the countersunk holes 17 in the right hinge leaf 14. The mounting plate 27 has a groove 29 in and along its vertical edge away from the first gripping jaw 22, and a corresponding tongue 30 is integral with the second gripping jaw 23 for insertion into the groove 29. A mortise or rectangular recess 31 is provided in the edge 19 of the door 11 for neatly receiving the mounting plate 27 with its surface 32 flush with the surface of the door edge 19.

The mounting plate 27 and the pair of gripping jaws 22, 23 are mounted on the door 11 (FIG. 2), with the mounting plate seated in the recess 31 in the door edge 19 and with the tongue 30 on the second gripping jaw 23 received in the groove 29 in the mounting plate. The pair of gripping jaws 22, 23 are rigidly affixed to the door 11 by means of a set of bolts 33 inserted with clearance in the holes 26 in the door 11 through the holes 25 in the second gripping jaw 23 and a complemental set of nuts 34 inserted with clearance in the door holes 26 through the holes 24 in the first gripping jaw 22 and threadedly engaging the bolts 33. When attached to the door edge 19, the attachment device also serves as a reinforcement for the door edge 19.

The nuts 34 each comprise an internally threaded sleeve 35 having a head 36 at one end. The threaded shanks of the bolts 33 are fitted into and engage the sleeves 35 of the respective nuts 35 in the door holes 26.

Frame members extend along and embrace the peripheral edges of the door 11, the mounting plate 27 being disposed between the door 11 and one of the frame members 37. The frame member 37 is of I-shaped cross-section comprising a web 38 and a pair of flanges 39, 39 extending on and along the opposite longitudinal edges of the web.

The flanges 39, 39 have recesses 40 held in transverse or horizontal registry for receiving the right leaf 14 of the butt hinge 10. The web 38 of the frame member has a set of holes 41 disposed in two vertical rows in axial registry with the respective tapped holes 28 in the mounting plate 27 and with the respective countersunk holes 17 in the right hinge leaf 14 received in the frame member flange recesses 40. Held against the web 38 of the frame member 37, the right hinge leaf 14 is fastened to the mounting plate 27 by a set of threaded fasteners such as countersunk screws 42.

For fastening the right leaf 14 of the butt hinge 10 to the door 11, the set of holes 26 and the recess 31 are first formed in a desired position in the door. Then, the mounting plate 27 is fitted into the recess 31, with the first gripping jaw 22 held against one of the faces of the door 11, and the tongue 30 on the second gripping jaw 23 is received in the groove 29 in the mounting plate, with the second gripping jaw held against the other door face. The pair of gripping jaws 22, 23 are secured to the door by the bolts 33 and the nuts 34 inserted into the door holes 26 through the gripping jaw holes 24, 25.

The frame member 37 is then placed over the edge 19 of the door with its holes in registry with those of the mounting plate 27. Held against the web 38 of the frame member 37, the right hinge leaf 14 is then fastened to the mounting plate 27 by the screws 42 passing through the countersunk holes 17 in the hinge leaf and the holes 41 in the frame member web and threadedly into the tapped holes 28 in the mounting plate.

Figure 3:
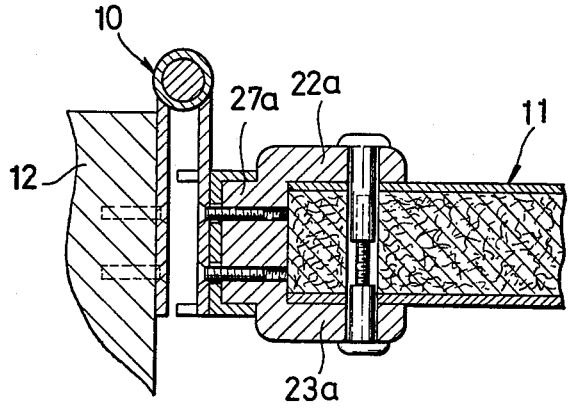
FIG. 3 is a view similar to FIG. 2 showing another preferred embodiment of the invention.

In another embodiment of this invention shown in FIG. 3, a pair of gripping jaws **22*a*, 23*a* are both integral with a mounting plate 27*a* placed in the edge 19 of the door 11. The other details of construction are identical with those set forth above. The attachment device of FIG. 3 is simpler in construction and easier to mount to the door, but the device shown in FIGS. 1 and 2** has the advantage that it is applicable to doors of various thickness.

In practical use of the door hinge attachment device of this invention, the construction, finish, and ornamentation of the gripping jaws may be suitably designed for an aesthetic appeal, in a manner not interfering with their mechanical functions. Furthermore, the frame member 37 may be omitted, and the right hand hinge leaf 14 may be fastened directly to the mounting plate 27.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A device for connecting the movable one of the leaves of a vertical axis butt hinge to a door having a recess in a vertical edge thereof, the movable hinge leaf having a first set of holes, said device comprising in combination:

(a) a pair of gripping jaws adapted to be disposed on the opposite sides of the door in spanning relationship to the recess in the vertical edge thereof, each of said gripping jaws having a second set of holes remote from the recess;

(b) fastener means adapted to extend through said second sets of holes in the jaws and through the door for rigidly connecting said pair of gripping jaws to the door by extending between and coupling the jaws together with the door clamped therebetween;

(c) a mounting plate coupled with said pair of gripping jaws so as to be disposed in the recess in the vertical edge of the door, said mounting plate having a third set of threaded holes; and (d) a plurality of threaded fasteners adapted to pass through the first set of holes in the movable hinge leaf and threaded into said third set of threaded holes in said mounting plate.

2. A device according to claim 1, each of said gripping jaws being vertically longer than said mounting plate.

3. A device according to claim 2, said mounting plate being located substantially centrally of the vertical length of said gripping jaws.

4. A device according to claim 1, each of said gripping jaws having a vertical edge located adjacent to said mounting plate, said mounting plate having a surface adapted to lie flush with the vertical door edge and to be connected to said movable hinge leaf, and said mounting plate having a pair of edges at which the mounting plate is coupled with said gripping jaws.

5. A device according to claim 4, said mounting plate being integral at one of its vertical edges with one of said gripping jaws adjacent to said vertical edge of the gripping jaw, said mounting plate having a groove in its other vertical edge, and the other of said gripping jaws having on said edge thereof a tongue snugly received in said groove.

6. A device according to claim 4, said mounting plate being integral at its vertical edges with said gripping jaws adjacent to said vertical edges of said gripping jaws.

7. A device according to claim 1, said mounting plate having a surface adapted to lie flush with the vertical edge of the door and having a pair of edges at which it is coupled with said gripping jaws, a frame member having a pair of spaced elongated flanges interconnected by an elongated web for extending along and embracing the vertical edge of the door, said web at one side engaging said surface of said mounting plate and said flanges engaging said pair of edges thereof, the movable hinge leaf being engageable with said web at its other side, said threaded fasteners also extending through a fourth set of holes in said web.

8. A device according to claim 7, in which said frame member has an I-shaped horizontal cross-section.

9. A door and butt hinge assembly comprising:

(a) a door having a pair of face panels and a core of relatively soft material sandwiched therebetween, said door having a recess in a vertical edge thereof;

(b) a butt hinge having a pair of leaves, one being movable and having a first group of holes;

(c) a pair of gripping jaws disposed on the opposite sides of said door and each having a second group of holes;

(d) fastener means rigidly connecting said pair of gripping jaws to the door by extending between and coupling the jaws together with the door therebetween, said fastener means extending through said second groups of holes in the jaws and through the door;

(e) a mounting plate coupled with said vertical gripping jaws and disposed in said recess in the vertical edge of said door, said mounting plate having a third group of threaded holes; and (f) a plurality of threaded fasteners passing through said first group of holes in said movable hinge leaf and threadedly into said third group of threaded holes in said mounting plate.

* * * * *